US005263657A

United States Patent [19]

Grotepass

[11] Patent Number: 5,263,657

[45] Date of Patent: Nov. 23, 1993

[54] ARRANGEMENT WITH A COIL FORMING AND CONVEYING SYSTEM FOR WIRE OR LIGHT-SECTION STEEL, PARTICULARLY FOR HIGH OIL WEIGHTS

[75] Inventor: Johann Grotepass, Ratingen, Fed. Rep. of Germany

[73] Assignee: SMS Schloemann-Siemag Aktiengesellschaft, Dusseldorf, Fed. Rep. of Germany

[21] Appl. No.: 844,251

[22] Filed: Mar. 2, 1992

[30] Foreign Application Priority Data

Mar. 1, 1991 [DE] Fed. Rep. of Germany ..... 4106491

[51] Int. Cl.[5] ..... B21C 47/24

[52] U.S. Cl. ..... 242/79

[58] Field of Search ..... 242/79, 80, 81, 82, 242/83, 84, DIG. 3; 140/2

[56] References Cited

U.S. PATENT DOCUMENTS

| | | | |
|---|---|---|---|
| 2,424,307 | 7/1947 | Dunbar | 242/79 |
| 2,743,066 | 4/1956 | Crum | 242/79 |
| 3,598,251 | 8/1971 | Sieurin | 242/79 X |
| 3,599,890 | 8/1971 | Atherton et al. | 242/79 |
| 3,832,788 | 9/1974 | Kato et al. | 242/79 X |
| 3,940,967 | 3/1976 | Vitelli | 140/2 X |
| 3,977,224 | 8/1976 | Stubbins | 242/79 X |
| 4,023,392 | 5/1977 | Fujita et al. | 140/2 X |
| 4,293,103 | 10/1981 | Tsukamoto | 242/83 |
| 4,350,311 | 9/1982 | Pokhodnya et al. | 242/84 X |
| 4,437,620 | 3/1984 | Ozawa | 242/84 X |

FOREIGN PATENT DOCUMENTS

| | | | |
|---|---|---|---|
| 0030428 | 6/1981 | European Pat. Off. | 242/79 |
| 2934439 | 4/1981 | Fed. Rep. of Germany . | |
| 2954521 | 4/1981 | Fed. Rep. of Germany . | |
| 3122405 | 1/1983 | Fed. Rep. of Germany | 242/79 |
| 3839814 | 12/1989 | Fed. Rep. of Germany | 242/79 |

*Primary Examiner*—Daniel P. Stodola
*Assistant Examiner*—John P. Darling
*Attorney, Agent, or Firm*—Anderson Kill Olick & Oshinsky

[57] ABSTRACT

An arrangement with a coil forming and conveying system for wire or light-section steel, particularly with high coil weights of up to 5 t. The arrangement includes one or more conveying units for supplying the wire and a coil forming and transfer station each following the one or more conveying units. The coil forming and transfer stations include a device for conveying wire coils to an unloading station. The coil forming station and the transfer station form a unit. The transfer station includes a relatively elongated C-shaped hook which is connectable to the coil forming station. The C-shaped hook includes a receiving mandrel adjacent the receiving mandrel for conveying and compacting wire or light-section steel windings placed from the coil forming station onto the receiving mandrel. The hook includes travel gear so as to be movable between the transfer station and the unloading station.

10 Claims, 4 Drawing Sheets

FIG. 2
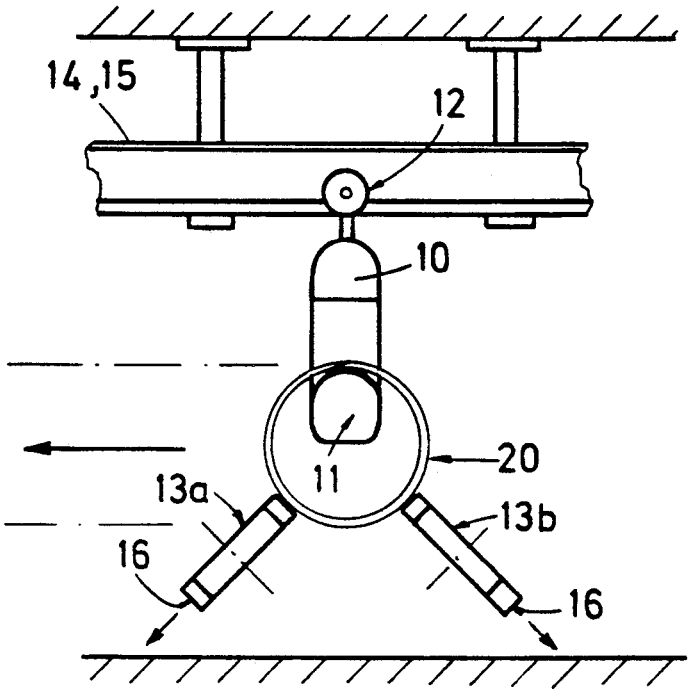
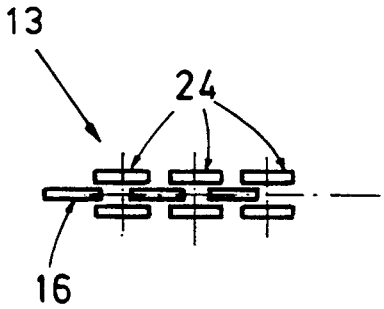
FIG. 3

ARRANGEMENT WITH A COIL FORMING AND CONVEYING SYSTEM FOR WIRE OR LIGHT-SECTION STEEL, PARTICULARLY FOR HIGH OIL WEIGHTS

BACKGROUND OF THE INVENTION

1. Field of the Invention

The present invention relates to an arrangement with a coil forming and conveying system for wire and/or light-section steel, particularly with high coil weights of up to 5 t. The arrangement includes one or more supplying conveying units and a coil forming and transfer station each following the one or more conveying units. The coil forming and transfer stations include means for conveying wire coils to an unloading station.

2. Description of the Related Art

Arrangements for receiving and for conveying wire coils formed in a coil forming chamber are known from patents DE-C2-29 34 439 and DE-C2-29 54 521. Each of these arrangements includes a rotating frame with an axis of rotation which is inclined relative to the vertical. The rotating frame includes several receiving mandrels which are arranged with uniform spacings in circumferential direction and at an acute angle relative to the axis of rotation, so that the receiving mandrels are aligned vertically in the loading station underneath the coil forming chamber and in the region of a transfer unit are inclined relative to the transfer unit. The transfer unit receives a coil from a receiving mandrel and transfers this coil to a conveying unit which is equipped with elements for displacing the coil stop surfaces of the mandrels. The rotating frame is constructed for a plurality of receiving mandrels as a coil and displacement disk whose axis forms an angle of less than 45° with the vertical and an acute angle with each axis of a receiving mandrel. The receiving mandrels are mounted on the wire coil and displacement disk so as to be raisable and lowerable by means of lifting devices. In the construction according to DE-C2-29 34 439, each receiving mandrel is additionally constructed with a spreading device and with a single drive actuating the spreading device.

The known arrangements have several disadvantages. Thus, the arrangements require a particularly high structural height with components of the arrangement being located in two planes. For this purpose, the arrangements require substantial foundations which to a large extent are below mill floor level in a foundation pit. A frame of steel girders in a plane above mill floor level is provided for conveying the coils. The coil tilting device or the rotating frame with the coil transfer unit and the conveying system, as well as the corresponding rotating devices, lifting devices and travel devices result in extremely high investment and operation costs, particularly energy costs, as well as substantial maintenance.

SUMMARY OF THE INVENTION

It is the object of the present invention to provide an arrangement with a coil forming and conveying system of the type described above which is significantly simplified and improved, so that, without requiring large structural heights and several planes of operation as well as a substantial foundation, the transfer of wire or light-section coils from a coil forming station to a transfer station and from the latter to means for receiving and further conveying the coils can be made possible in a particularly economical, well-organized and flexible manner.

In accordance with the present invention, the coil forming station and the transfer station form a unit. The transfer station includes a relatively elongated C-shaped hook which is connectable to the coil forming station. The C-shaped hook includes a receiving mandrel and means adjacent the receiving mandrel for conveying and compacting the wire or light-section steel windings or coils placed from the coil forming station onto the receiving mandrel. The hook includes travel means so as to be movable from the transfer or loading station to the unloading station.

Compared to conventional plants and arrangements of the above-described type, the arrangement according to the present invention provides significant advantages. Especially the low structural height and the fact that substantial foundation structures and a foundation pit underneath the floor level are not required and the significant simplification of the technical plant requirements result advantageously in a drastic reduction of the investment costs as well as the operation costs. Not required in the arrangement according to the present invention are the complicated machines required in the arrangements of the state of the art, particularly the technically complicated coil tilting device with the subsequently arranged conveying and coil transfer system with conveying means from a lower work plane to a higher work plane. As a result, the arrangement according to the present invention is well organized, flexible and requires hardly any maintenance.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

BRIEF DESCRIPTION OF THE DRAWING

In the drawing:

FIG. 2 is a frontal view, on a larger scale, of the transfer or loading station of the arrangement of FIG. 1;

FIG. 3 shows a detail of a conveyor chain with loose rollers;

DESCRIPTION OF THE PREFERRED EMBODIMENT

Figure 1:
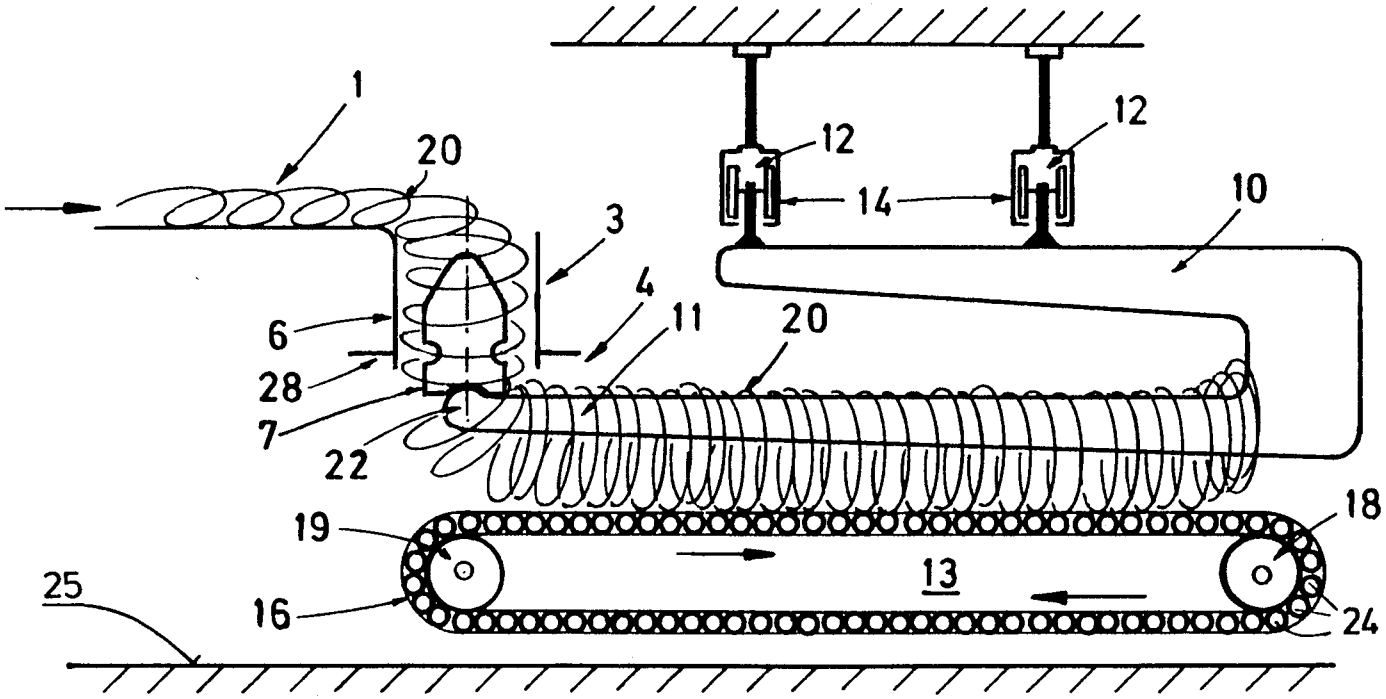
FIG. 1 is a schematic side view of an arrangement according to the present invention with a coil forming station and transfer station.

FIG. 1 of the drawing is a partial illustration of an arrangement with a coil forming and conveying system for wire and light-section steel. In particular, FIG. 1 shows the end of a conveying unit 1 for wire windings 20 with a coil forming station 3 and a transfer and loading station 4. The conveying unit 1, for example, a Stelmor unit, conveys wire windings 20 from a wire finishing train, not shown, to a coil forming chute 6. A coil receiving mandrel 7 is located in the interior of the coil forming chute 6. Support arms 28 hold the coil receiving mandrel in its position in the coil forming chute 6.

The support arms 28 are constructed in such a way that, for example, when the support arms are retracted as ilustrated in FIG. 1, wire windings 20 can be received by the coil receiving mandrel 7. The wire windings drop onto the tip 22 of the receiving mandrel 11 of the C-shaped hook 10 in the region of the transfer station 4. When the wire windings of a rolling length have been completely received by the C-shaped hook 10, the support arms 28 are swung in in order to hold the coil receiving mandrel 7. The windings of the new rolling length can now already be collected above the support arms 28. This is done for as long as it takes to replace the loaded C-shaped hook 10 by an empty C-shaped hook 10. The support arms 28 are then retracted and the coil receiving mandrel 7 drops onto the tip 22 of the receiving mandrel 11. The entire rolling length can now again be received by the C-shaped hook 10.

The coil forming station 3 and the transfer and loading station 4 cooperating with the coil forming station 3 form a unit. The coil forming station 3 is followed by or engaged by the relatively elongated C-shaped hook 10 with its receiving mandrel 11 and the means 13 adjacent the receiving mandrel for conveying and compacting the wire and light-section steel windings into coils 20.

Figure 4:
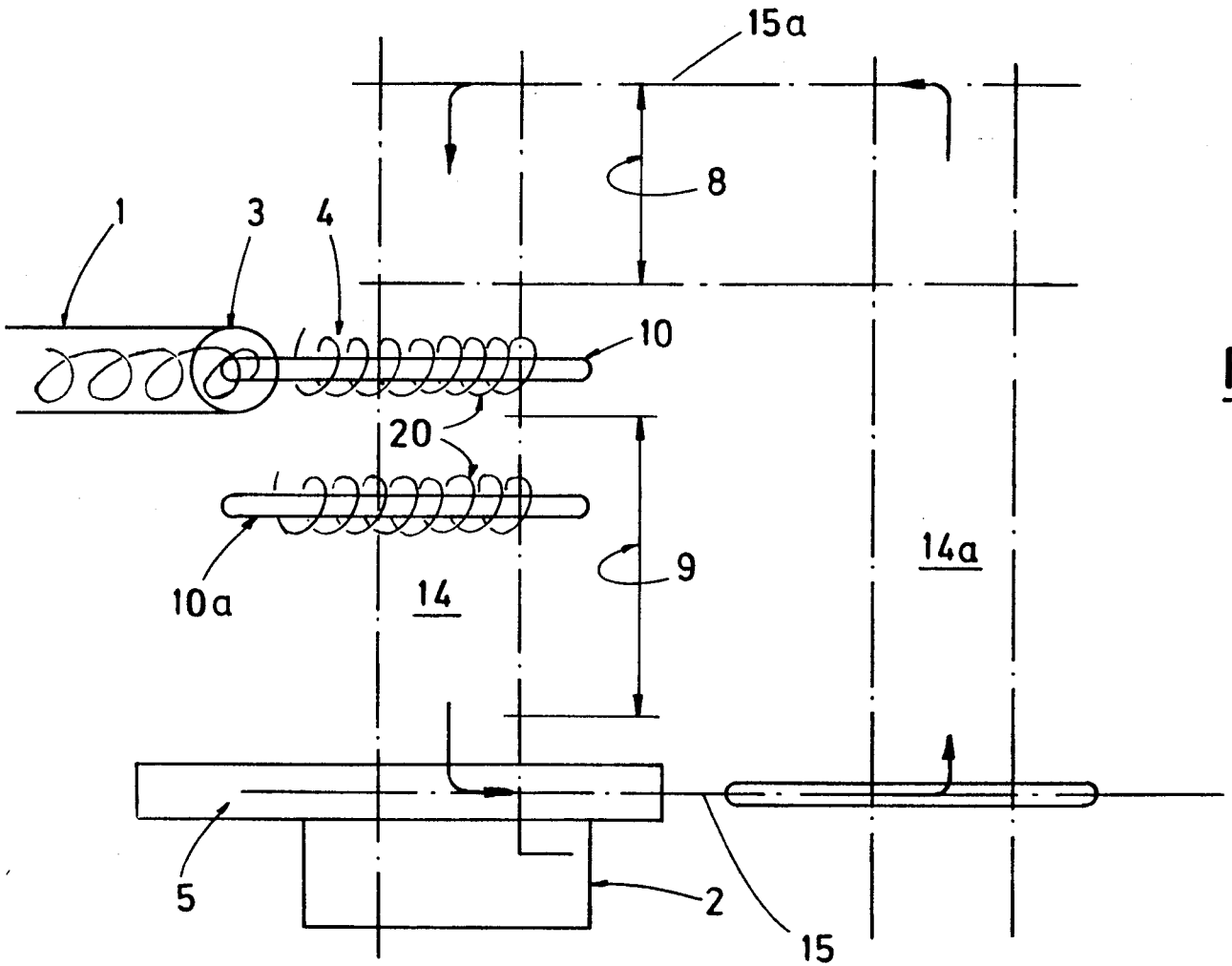
FIG. 4 is a top view showing the layout of an arrangement with a coil forming and conveying system.
Figure 5:
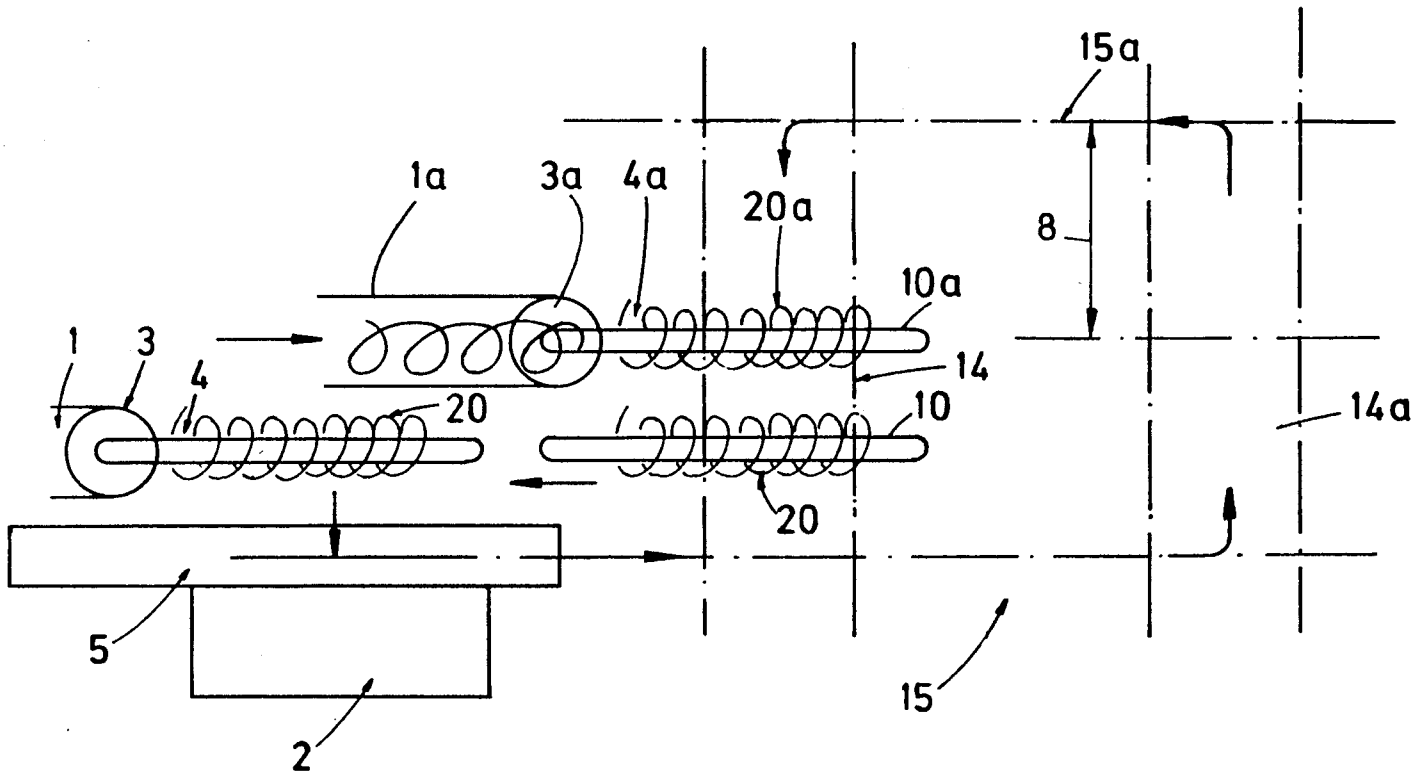
FIG. 5 is a top view of another layout of the arrangement of FIG. 1.

The hook 10 is arranged so as to be movable in a plane of the mill floor level 25 by means of travel means 12 from the transfer and loading station 4 to an unloading station designated by reference numeral 2 in FIGS. 4 and 5. Advantageously, the hook 10 is suspended with a traveling gear 12 from rails 14 and 15, also shown in FIGS. 4 and 5. Contrary to conventional arrangements, this travel arrangement can be used advantageously and without problems in the arrangement according to the present invention because the transfer and loading station 3, 4 and the unloading station 2 are located on the same level of operation of the mill floor level 25.

As is clear from FIGS. 1 and 2 of the drawing, the means 13 for conveying and/or compacting wire or light-section steel windings 20 are support and conveyor tracks 13*a*, 13*b* with chains which endlessly travel around a drive roller 18 and guide roller 19 each. The support and conveyor tracks 13*a*, 13*b* extend radially around the receiving mandrel 11 and in direction along the receiving mandrel 11.

As FIG. 2 further shows, adjacent the hook 10 or its receiving mandrel 11 are arranged in the region of the transfer and loading station 4 preferably two lowerable support and conveyor tracks 13*a* and 13*b* in a radial position underneath the hook 10. However, additional conveyor tracks interacting with the wire windings 20 may be provided, possibly even laterally of the hook 10.

The detail illustrated in FIG. 3 of the drawing shows a conveyor means 13 for conveying wire windings 20. Specifically, FIG. 3 shows that the chain 16 is equipped with loose rollers 24 which serve the purpose to gently place and compact the wire windings 20 on the mandrel 11 of the hook 10, while it is prevented that the chain 16 hooks into the wire windings 20 so that it is ensured that the chains 16 operate without wear and in a gentle manner.

FIG. 4 of the drawing is a schematic top view showing a layout of an arrangement according to the present invention with a coil forming and conveying system for wire and light-section steel. The arrangement includes the coil forming station 3 with integrated transfer and loading station 4 arranged in a closed rail track 14, 15, 14*a*, 15*a* with hooks 10 being arranged so as to travel on the rail tracks. The track sections 14, 14*a* are intended for transverse travel of the hooks 10 and the track sections 15, 15*a* are intended for longitudinal travel. The arrangement additionally includes within the rail track 14, 15, 14*a*, 15*a* a coil press 5 and an unloading station 2. A buffer distance 9 for loaded hooks 10*a* may advantageously be provided between the transfer station 4 and the unloading station 2 or coil press 5. In addition, a storage distance 8 for empty C-shaped hooks 10 is provided. The rail tracks formed with the connected track sections 14, 14*a* for transverse travel and track sections 15, 15*a* for longitudinal travel a conveying track which forms a closed circle.

FIG. 5 of the drawing shows an arrangement according to the present invention with a coil forming and conveying system for wire or light-section steel which is particularly advantageous with respect to space. Two or more coil forming stations 3, 3*a* and transfer and loading stations 4, 4*a* are arranged adjacent the track section 14 for transverse travel. The stations 3, 3*a*; 4, 4*a* may be arranged offset and are followed by longitudinal displacement means, not shown, for the C-shaped hooks 10, 10*a* and for the means 13 for conveying and compacting the windings into coils which interact with the hooks 10, 10*a*. In an arrangement having the layout shown in FIG. 5, it is possible, for example, to provide a coil forming station 3 with a loading station 4 for wire and another coil forming station 3*a* with a loading station 4*a* for light-section steel, such as round steel, etc. Since the coil pressing station 5 and unloading station 2 are arranged laterally offset next to the rail tracks 14, 15, 14*a*, 15*a* the entire arrangement requires little space and permits an extremely economical operation between loading and unloading of the C-shaped hooks 10 with relatively high throughput rates. An operational flexibility is obtained which is significantly more advantageous as compared to conventional arrangements whose operational possibilities are severely restricted. As is clear from the above description and from the drawings, the technical means required for the operation of the arrangement according to the present invention require only a fraction of the means needed, for example, in the above-mentioned conventional arrangement.

While specific embodiments of the invention have been shown and described in detail to illustrate the inventive principles, it will be understood that the invention may be embodied otherwise without departing from such principles.

I claim:

1. An installation with a coiling and conveyance system for wire or light section steel windings, with at least one supplying conveyance installation and a coiling and transfer station with means for conveyance for wire coils to an unloading station respectively located downstream of said supplying conveyance installation, wherein said coiling station (3) comprises an elongated C-shaped hook (10) with a threading spike (11), displaceable by travel means (12) from said transfer or loading station (4) to said unloading station (2), characterized in that said coil receiving spike (7) of said coiling station (3) and said threading spike (11) of said hook (10) form a single functional unit, wherein said threading spike (11) comprises means (13) for threading and compacting said wire or light steel windings (20) supplied by said coil receiving spike (7) of said coiling station (3) to said threading spike (11) of said C-shaped hook (10) and said means (13) for threading and compacting said wire or light steel windings (20) are support and conveyor rail tracks (13*a*, 13*b*) with chains (16) endlessly revolving around respectively on drive (18) and reversing roller (19) disposed radially around said threading spike (11) and said wire windings (20) to be threaded as well as extending in a longitudinal direction said threading spike (11).

2. The installation according to claim 1, wherein a tip of said threading spike (11) is joined with said coil receiving spike (7).

3. The installation according to claim 1, wherein at least said support- and conveyor rail tracks (13*a*, 13*b*) spaced from said threading spike in radial position below said C-shaped hook (11) are displaceable below said threading spike.

4. The installation according to claim 1, wherein chains (16) are equipped with loose rollers (24) disposed on opposite sides of each respective chain.

5. The arrangement according to claim 4, wherein said transfer or loading station (4) and said unloading station (2) are disposed in said same operational plane of a mill (25).

6. The installation according to claim 4, wherein said hook (10) is displaceable by travel means (12) being suspended from conveying rails (14, 15) and adjacent said C-shaped hook (10).

7. The installation according to claim 1, comprising a coil press arranged adjacent said unloading station.

8. The installation according to claim 3, wherein said conveying rails include a storage distance for empty C-shaped hooks and a buffer distance for C-shaped hooks which are loaded with coils.

9. The installation according to claim 3, wherein said conveying rails include track sections for transverse travel and track sections for longitudinal travel, wherein said track sections form a conveyor path which is closed in a circle.

10. The installation according to claim 9, wherein two or more coil forming stations and transfer stations are arranged at a track section for transverse travel.

* * * * *